US006595849B2

(12) United States Patent
Miller

(10) Patent No.: US 6,595,849 B2
(45) Date of Patent: Jul. 22, 2003

(54) ROOF VENTILATION SYSTEM

(76) Inventor: Nathan Allen Miller, 12303 Highway 70N, Crossville, TN (US) 38571

( * ) Notice: Subject to any disclaimer, the term of this patent is extended or adjusted under 35 U.S.C. 154(b) by 0 days.

(21) Appl. No.: 10/218,077

(22) Filed: Aug. 13, 2002

(65) Prior Publication Data

US 2003/0022618 A1 Jan. 30, 2003

Related U.S. Application Data

(63) Continuation of application No. 09/748,091, filed on Dec. 27, 2000, now abandoned.

(51) Int. Cl.[7] ..... F24F 7/02
(52) U.S. Cl. ..... 454/365; 52/199
(58) Field of Search ..... 454/365; 52/198, 52/199

(56) References Cited

U.S. PATENT DOCUMENTS 3,949,657 A 4/1976 Sells
4,843,953 A 7/1989 Sells
5,054,254 A 10/1991 Sells
5,561,953 A 10/1996 Rotter
5,704,834 A 1/1998 Sells
5,826,383 A 10/1998 Garrison
6,079,166 A 6/2000 Mason et al.
6,267,668 B1 7/2001 Morris

*Primary Examiner*—Harold Joyce
(74) *Attorney, Agent, or Firm*—Luedeka, Neely & Graham PC

(57) ABSTRACT

A ventilation system to be used over roofing materials that have ribs or corrugations on their surface such as might be found on preformed metal roofing panels. This ventilation system consists of narrow strips of material that are to be placed end to end in such a way as to form a long continuous strip. They are then covered by a typical ridge cap or other flashing material allowing the ventilation air to pass over the roofing material but under the ridge cap or flashing material. The resulting ventilation system is impervious to normal temperature extremes and wind born materials such as rain or snow.

11 Claims, 1 Drawing Sheet

ROOF VENTILATION SYSTEM

CROSS-REFERENCE TO RELATED APPLICATION

This application is a continuation of application Ser. No. 09/748,091, filed Dec. 27, 2000, now abandoned, and entitled THE GREAT EVENT.

FIELD OF THE INVENTION

The present invention relates to roof ventilation, particularly to ventilation of roofs comprised of formed panels such as metal roofing.

BACKGROUND AND SUMMARY OF THE INVENTION

A ventilating system for these roofing panels must first of all be impervious to temperature and moisture extremes that are normally found in these outdoor environments. It must exclude all objectionable insects and rodents from the area to be ventilated. It would ideally be east to install without requiring extensive training to otherwise qualified roofing installers. It must be cost effective. It must, of course, ventilate the open space below said roofing panels effectively.

While Applicant acknowledges other method of ventilating said roofing systems, he asserts that all of these fail in one or more of the above mentioned areas.

Some embodiments of this new invention will now be described with reference to the drawings in which:

DETAILED DESCRIPTION

Figure 1:
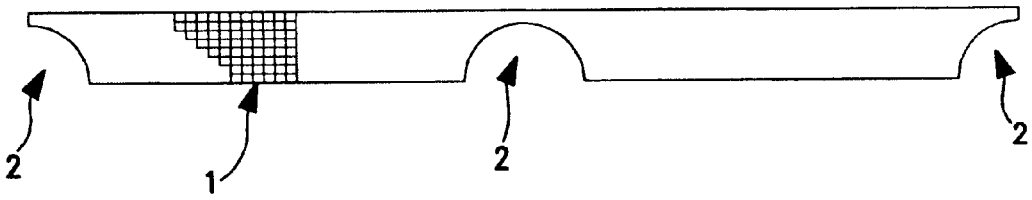
FIG. 1 is a side view of the vent invention.
Figure 2:
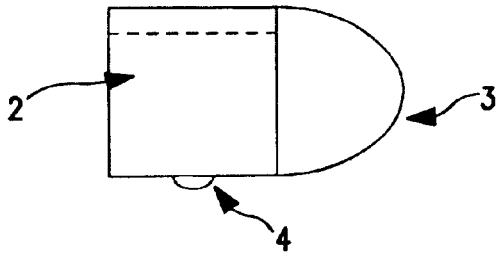
FIG. 2 is an end view of the said invention.
Figure 3:
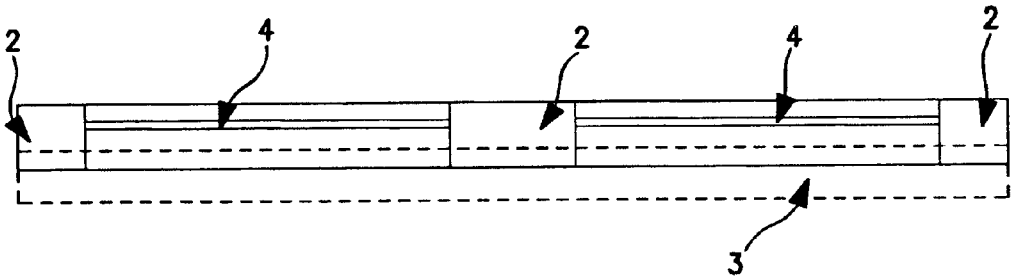
FIG. 3 is a bottom view of said invention.

The roof ventilation system or product in 1 is comprised of multiple layers of corrugated plastic built up to a sufficient thickness to cover the tallest point of the profile of the roofing material beneath it. By virtue of the corrugations in the plastic, air may freely flow through the product 1 to the outside of the building envelope, thereby accomplishing the desired ventilation of the interior space.

The voids 2 are cut into the product 1 in order to allow the product 1 to nest snugly over the profile of the roofing material beneath it. Please note both the spacing and shape of these voids will vary depending on the profile of any given roofing material.

The membrane 3 is comprised of a mesh type non absorbent material permanently bonded product 1 on top and bottom. The purpose of membrane 3 is to help in shielding the building envelope from wind driven matter such as might be found in shallow sloped roofs or areas subjected to frequent high wind conditions. Membrane 3 is further cut at each void 2 to allow product 1 to nest snugly to roofing material. Please note that this membrane 3 may not be necessary in all cases to use in each application product.

The adhesive strip 4 found on the bottom of product 1 is to aid in ease of installation during windy conditions. It is not intended to be used as a permanent adhesive not as a sealant. Please note that it too may be necessary in all cases to use adhesive strip 4 in each application of product 1.

The main benefits of the product 1 are ventilation ability, durability, ease of installation, and cost savings. Other applications and benefits of this product may well be found without substantial modifications thereto.

What is claimed is:

1. A ventilation system for roofs of the type made of formed roofing materials of the type having upstanding ribs or corrugations and including an open vent space covered with a ridge cap or a flashing material, the ventilation system comprising a plurality of strips of a corrugated material positionable in an end-to-end relationship with one another adjacent the open vent space of the roofing material, wherein each of the strips of corrugated material includes a substantially planar upper surface positionable adjacent the ridge cap or flashing of the roof and a bottom surface having a plurality of discrete and spaced apart voids defined therein and located to correspond to the configuration and spacing of the ribs or corrugations of the roofing material so that the ventilation system nests snugly over the formed roofing materials and ventilation air flows through the vent space and the corrugations of the strips of corrugated material.

2. The ventilation system of claim 1, further comprising a membrane bonded to a portion of the corrugated material and in flow communication with the corrugated material so as to allow air to pass through the corrugated material while inhibiting the passage of wind born matter into the corrugated material.

3. The ventilation system of claim 1, further comprising an adhesive strip on the bottom surface of the corrugated material adjacent the voids for securing the corrugated material to the formed roofing materials.

4. A ventilation system for use with roofs of the type constructed of formed panels having a predetermined profile, the system comprising an elongate sheet of a corrugated material having first and second opposite and substantially planar surfaces with corrugations therebetween and extending substantially perpendicular to the length of the corrugated materials, the corrugations defining a plurality of ventilation paths, and a plurality of voids defined adjacent the first surface and extending toward the second surface to enable the corrugated material to be placeable adjacent a roofing surface defined by the roofing panels with the voids of the corrugated material configured to nest with the profile of the panels.

5. The ventilation system of claim 4, wherein the corrugated material comprises a plurality of layers of corrugated material.

6. The ventilation system of claim 1, further comprising a mesh material secured adjacent an edge of the corrugated material so as to substantially overly an exposed edge of the corrugations so as to inhibit the passage of matter into the corrugations.

7. The ventilation system of claim 1, further comprising an adhesive adjacent the first surface for securing the first surface to roof panels.

8. A roof structure comprising a plurality of roof panels having a predetermined profile, an open space defined adjacent the roof panels and extending between an interior and exterior of a roof structure, a vent structure mounted adjacent the panels and the open space and being air permeable so as to permit air to travel between the interior and the exterior of the roof structure, the vent structure comprising an elongate sheet of a corrugated material having first and second opposite and substantially planar surfaces with corrugations therebetween and extending substantially perpendicular to the length of the corrugated material, the corrugations defining a plurality of ventilation paths, and a plurality of voids for permitting the vent structure to nest snugly over the profile of the panels, each of the voids being defined adjacent the first surface and extending toward the second surface and configured to nest with the profile of the panels.

9. The roof structure of claim 8, wherein the corrugated material comprises a plurality of layers of corrugated material.

10. The roof structure of claim 8, wherein the vent structure further includes a mesh material secured adjacent an edge of the corrugated material so as to substantially overly an exposed edge of the corrugations so as to inhibit the passage of matter into the corrugations.

11. The roof structure of claim 8, further comprising an adhesive adjacent the first surface for securing the first surface to the roof panels.

* * * * *